US012612686B2

(12) United States Patent
Zhang et al.

(10) Patent No.: US 12,612,686 B2
(45) Date of Patent: Apr. 28, 2026

(54) STEEL, STEEL BAR AND MANUFACTURING METHOD THEREOF

(71) Applicant: BAOSHAN IRON & STEEL CO., LTD., Shanghai (CN)

(72) Inventors: Jun Zhang, Shanghai (CN); Sixin Zhao, Shanghai (CN); Jiaqiang Gao, Shanghai (CN); Wei Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 921 days.

(21) Appl. No.: 17/609,247

(22) PCT Filed: May 25, 2020

(86) PCT No.: PCT/CN2020/092113
§ 371 (c)(1),
(2) Date: Nov. 5, 2021

(87) PCT Pub. No.: WO2020/238851
PCT Pub. Date: Dec. 3, 2020

(65) Prior Publication Data

US 2022/0195571 A1 Jun. 23, 2022

(30) Foreign Application Priority Data

May 28, 2019 (CN) ..... 201910451727.4

(51) Int. Cl.
*C22C 38/54* (2006.01)
*C21D 1/18* (2006.01)
(Continued)

(52) U.S. Cl.
CPC ..... *C22C 38/54* (2013.01); *C21D 1/18* (2013.01); *C21D 8/065* (2013.01); *C21D 9/0075* (2013.01);
(Continued)

(58) Field of Classification Search
None
See application file for complete search history.

(56) References Cited

U.S. PATENT DOCUMENTS

2010/0024926 A1* 2/2010 Nagao ..... C21D 8/0205 148/330
2015/0118098 A1 4/2015 Valls
(Continued)

FOREIGN PATENT DOCUMENTS

CN 103667953 A 3/2014
CN 104962832 A 10/2015
(Continued)

OTHER PUBLICATIONS

Machine translation of CN 109136737A. (Year: 2019).*
(Continued)

*Primary Examiner* — Xiaowei Su
(74) *Attorney, Agent, or Firm* — Amster, Rothstein & Ebenstein LLP

(57) ABSTRACT

Provided is a steel comprising the following chemical composition in percentage by mass: 0.150-0.250% of C, 0.10-0.50% of Si, 0.60-1.50% of Mn, 0.30-1.20% of Cr, 0.20-0.80% of Mo, 2.00-4.00% of Ni, 0-0.10% of Nb, 0.0010-0.0050% of B, 0-0.12% of V, 0.003-0.06% of Ti, 0.01-0.08% of Al, the balance being Fe and unavoidable impurities. Also provided is a steel bar and a manufacturing method thereof.
(Continued)

The steel bar is made from the above steel. The manufacturing method comprises the steps of smelting and casting, heating, forging or rolling, quenching, and tempering.

11 Claims, 2 Drawing Sheets

(51) Int. Cl.

| | |
|---|---|
| ***C21D 8/06*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/002* (2013.01); *C21D 2211/008* (2013.01)

(56) References Cited

U.S. PATENT DOCUMENTS

| | | | | |
|---|---|---|---|---|
| 2017/0096719 | A1 | 4/2017 | Valls Anglés | |
| 2021/0381086 | A1* | 12/2021 | Shuto ..... | C21D 8/0236 |
| 2023/0094959 | A1* | 3/2023 | Zhao ..... | C21D 1/58 148/548 |

FOREIGN PATENT DOCUMENTS

| | | | |
|---|---|---|---|
| CN | 106086639 | A | 11/2016 |
| CN | 106636928 | A | 5/2017 |
| CN | 106521356 | B | 12/2017 |
| CN | 109136737 | A | 1/2019 |
| JP | S6227517 | A | 2/1987 |
| JP | H07126797 | A | 5/1995 |
| JP | H07278738 | A | 10/1995 |
| JP | 2003113439 | A | 4/2003 |
| JP | 2007-009325 | A | 1/2007 |
| JP | 4464735 | B2 | 5/2010 |
| RU | 2321668 | C2 | 4/2008 |
| WO | 2014114159 | A1 | 7/2014 |
| WO | 2018033960 | A1 | 2/2018 |
| WO | 2019092576 | A1 | 5/2019 |

OTHER PUBLICATIONS

International Search Report, dated Aug. 19, 2020 in corresponding International Application No. PCT/CN2020/092113.

Extended European Search Report, dated Aug. 23, 2022, in Application No. 20813182.1-1103 / 3954799 PCT/CN2020092113.

* cited by examiner

STEEL, STEEL BAR AND MANUFACTURING METHOD THEREOF

CROSS REFERENCE TO RELATED APPLICATIONS

This application is a national phase of PCT application No. PCT/CN2020/092113, filed May 25, 2020, which claims priority to Chinese patent application No. 201910451727.4 filed on May 28, 2019, all of which are incorporated herein by reference thereto.

TECHNICAL FIELD

The present disclosure relates to steel materials having ultra-high strength and manufacturing method thereof, and in particular relates to low temperature steel having ultra-high strength, steel bar and manufacturing method thereof.

BACKGROUND

Low temperature steel bar having ultra-high strength and toughness can be used in the production of mooring chains for offshore platform, high-safety machinery and structural components. With the exploitation of marine resources in the deep sea, the offshore platforms become larger and more complicate in structure and functions, and the requirements on mooring chains for offshore platform have also increased. The working environment for the offshore platform mooring chains is harsh due to high tensile loads, seawater impact from the motion of waves, seawater erosion and microbial corrosion.

The steel for mooring chains of the large-scale offshore platforms requires higher strength and higher impact toughness. At present, the grades of the steel for mooring chains of the large-scale offshore platforms are mainly R3, R3S, R4, R4S and R5, of which the tensile strengths are 690 MPa, 770 MPa, 860 MPa, 960 MPa and 1000 MPa, respectively.

On this basis, it is desired to obtain a low-temperature ductile steel with ultra-high strength. At present, researches on high-strength ductile steel in China and abroad are generally conducted by selecting suitable chemical components and using controlled rolling and controlled cooling or quenching and tempering process to produce high-strength ductile steel satisfying the requirements on mechanical properties. However, when controlled rolling and controlled cooling process is adopted to produce high-strength steel, it is difficult to control the parameters in the rolling and cooling process, which would affect the overall uniformity of the mechanical properties of the steel. When quenching and tempering process is adopted to produce high strength steel, the hardenability of the steel is improved by optimizing the contents of alloying elements and carbon, so that the steel forms a martensite structure during the cooling process. Martensite is a square lattice formed by dissolving carbon in a body-centered cubic lattice of Fe atoms where bcc lattice extends along the c-axis. Such structure has high strength and hardness. High strength steel mainly containing martensite typically has poor low-temperature impact energy due to its high strain storage energy up to 1000 J/mol and high dislocation density. However, as martensitic high strength steel has high density dislocation and sub-grain boundaries, it would break and fail swiftly if micro deficiencies such as micro cracks appear during the stretching process and thus resulting in low elongation rate.

For example, Chinese Patent Application Publication No. CN 103667953 A (publication date Mar. 26, 2014), title "oceanic mooring chain steel with low environmental crack sensitivity and ultrahigh obdurability and preparation method thereof" discloses an oceanic mooring chain steel with low environmental crack sensitivity and ultrahigh obdurability and preparation method thereof. According to the technical solutions disclosed in the patent, the composition of the steel comprises the following components in percentage by mass: C: 0.12~0.24, Mn: 0.10~0.55, Si: 0.15~0.35, Cr: 0.60~3.50, Mo: 0.35~0.75, N≤0.006, Ni: 0.40~4.50, Cu≤0.50, S≤0.005, P: 0.005~0.025, O≤0.0015, H≤0.00015, balance of Fe and inevitable impurities.

As another example, Chinese Patent Application Publication No. CN 101519751 (publication date Sep. 2, 2009), title "high performance marine mooring chain steel and manufacturing method thereof" discloses a high performance marine mooring chain steel and manufacturing method thereof. According to the technical solutions disclosed in the patent, the composition of the steel comprises the following by weight percentage: C: 0.16~0.27, Mn: 0.40~1.05, Si: 0.15~0.50, Cr: 1.25~2.50, Mo: 0.20~0.60, Al: 0.01~0.06, N: 0.004~0.015, S≤0.005, P≤0.015, balance of Fe and inevitable impurities. The overall mechanical properties of such mooring chain steel are as follows: tensile strength $\sigma b \geq 1000$ MPa, elongation rate δ?15%, percentage reduction of area after fracture $\psi \geq 55\%$, impact energy at −20° C. Akv≥80 J, yield-to-strength ratio $\sigma s/\sigma b \leq 0.92$.

SUMMARY

One of the objects of the present disclosure is to provide a low temperature ductile steel with ultra-high strength that can achieve a tensile strength of 1150 MPa and good toughness at low temperature and elongation rate. The steel of the present disclosure is suitable for applications where high-strength and toughness materials are required, such as mooring chains for offshore platform, automobiles and mechanical structures.

In order to achieve the above object, the present disclosure provides a low temperature ductile steel with ultra-high strength comprising the following chemical composition in percentage by mass:

C: 0.150~0.250%, Si: 0.10~0.50%, Mn: 0.60~1.50%, Cr: 0.30~1.20%, Mo: 0.20~0.80%, Ni: 2.00~4.00%, Nb: 0~0.10%, B: 0.0010~0.0050%, V: 0~0.12%, Ti: 0.003~0.06%, Al: 0.01~0.08%, balance of Fe and inevitable impurities.

With respect to the low temperature ductile steel with ultra-high strength according to the present disclosure, the design principle of each chemical element is as follows:

Carbon (C): with respect to the low temperature ductile steel with ultra-high strength according to the present disclosure, C is added to the steel to improve the hardenability, so that the steel may form a low temperature phase transformation structure having high hardness during the quenching and cooling process, thereby improving the strength of the steel. In addition, if the mass percentage of C is increased, the ratio of hard phases such as martensite phase and lower bainite phase would increase. In this way, although the hardness of the steel can be increased, the toughness would also decrease. However, if the mass percentage of C is too low, it would lower the amount of low temperature phase transformation structure such as martensite and lower bainite, and high tensile strength would not be achieved. On this basis, the mass percentage of C in the low temperature ductile steel with ultra-high strength according to the present disclosure is controlled at 0.150 to 0.250%.

Silicon (Si): in the technical solution of the present disclosure, Si replaces Fe atoms in a substitution manner in the steel, hindering the movement of dislocations, and is beneficial to the improvement of steel strength. Si may reduce the diffusion capacity of C in ferrite. Therefore, the formation of coarse carbides and precipitation at dislocations during tempering may be prevented thanks to suitable amount of Si. However, high Si mass percentage may reduce the impact toughness at low temperature of the steel. On this basis, the mass percentage of Si in the low temperature ductile steel with ultra-high strength according to the present disclosure is controlled at 0.10~0.50%.

Manganese (Mn): with respect to the low temperature ductile steel with ultra-high strength according to the present disclosure, Mn is a stabilizing element of retained austenite. Mn presented in the steel is mainly in the form of solid solution. During the quenching process of the steel, Mn may suppress the diffusion-type phase transformation, improve the hardenability of the steel and form a low-temperature phase transformation structure having high strength. However, excessively high Mn mass percentage may result in the formation of more retained austenite and reduce the yield strength of the steel. Moreover, as manganese containing steel is sensitive to overheating, too high mass percentage of Mn may result in growth of austenite grains during heating in the quenching process. Mn may promote the segregation of harmful elements at the grain boundaries and increase the tendency of temper brittleness of steel. Therefore, in the technical solution of the present disclosure, Mn is added in an amount of 0.60~1.50% by mass to improve the hardenability of the steel, while preventing the formation of too much retained austenite and reducing the overheating sensitivity of the steel.

Chromium (Cr): with respect to the low temperature ductile steel with ultra-high strength according to the present disclosure, the addition of Cr may reduce the driving force for phase transformation from $\gamma$ to $\alpha$, prevent carbide nucleation and growth during phase transformation, suppress the diffusion-type phase transformation, improve the hardenability of steel, form hardened martensite structure and obtain steel with higher strength. However, if the Cr carbide is not completely dissolved during the heating process, it may suppress the growth of austenite grains. In addition, if the mass percentage of Cr is too high, coarse carbides would be formed and deteriorates low temperature impact performance. Therefore, the mass percentage of Cr in the low temperature ductile steel with ultra-high strength according to the present disclosure is controlled at 0.30~1.20% to ensure the strength and low temperature impact performance of the steel.

Molybdenum (Mo): in the technical solution of the present disclosure, Mo is a ferrite-forming element, which would facilitate the hardenability of steel by forming bainite and martensite in the steel during quenching process. If the quenching speed is fast and the tempering temperature is low, Mo mainly present in the steel in the form of solid solution and further strengthens the effect of solid solubility. If the steel is quenched at a higher temperature, fine carbides may be formed to improve the strength of the steel. The carbides of Mo are stable and not easy to grow, which can refine the grains. However, given that Mo is a noble alloying element, the addition of high amount of Mo may lead to cost increase. Therefore, in the technical solution of the present disclosure, the mass percentage of Mo is controlled at 0.20~0.80% to reach the balance of toughness and welding performance.

Nickel (Ni): with respect to the low temperature ductile steel with ultra-high strength according to the present disclosure, Ni is presented in steel in the form of solid solution. In particular, in the composition system designed in this embodiment, Ni is presented in the form of face-centered cubic lattice of Fe—Ni—Mn to reduce stacking fault energy, reduce dislocation movement resistance, improve toughness of the steel matrix and improve low temperature impact performance of the steel. In addition, as Ni is an austenitizing element, excessively high Ni content may result in high content of retained austenite in steel and thus reduce the steel strength. On this basis, the mass percentage of Ni in the low temperature ductile steel with ultra-high strength according to the present disclosure is controlled at 2.00~4.00% to ensure the low temperature impact toughness and strength of the steel.

Niobium (Nb): in the technical solution of the present disclosure, Nb is added to the steel to suppress the recrystallization of steel. Nb is presented in the steel as a replacement of solute atom. As Nb atoms are larger in size than Fe atoms, they are easy to segregate at the dislocation line and produce strong dragging effect to the dislocation movement. Meanwhile, interstitial intermediate phases such as NbC and NbN can be formed by Nb in the steel, which hinders the pinning of dislocations and migration of sub-grain boundaries during the recrystallization process and refines the grains effectively. If Nb content is too high, coarse NbC particles may be formed under high temperature tempering conditions and deteriorates the low temperature impact energy of steel. Therefore, in conjunction with the control of other alloying elements, the mass percentage of Nb in the low temperature ductile steel with ultra-high strength according to the present disclosure is controlled at 0~0.10% to ensure the mechanical properties of the steel.

Boron (B): with respect to the low temperature ductile steel with ultra-high strength according to the present disclosure, B can alter the solidification process and as-cast structure, and react with molten steel to form fine particles, which become the non-spontaneous nucleation core in the solidification process, thereby reducing the nucleation energy and increasing the nucleation rate. Meanwhile, B is a surface active element in steel and can be easily absorbed at the surface of the solid crystal nucleus, thereby preventing crystal growth by hindering the supply of atoms required for crystal growth and greatly improving the hardenability of the steel at the same time. Thus, B can refine as-cast structure and reduce dendrite and regional segregation, and improve the uniformity and hardenability of the steel. On this basis, in the technical solution of the present disclosure, the mass percentage of B is controlled at 0.0010~0.0050%.

Vanadium (V): with respect to the low temperature ductile steel with ultra-high strength according to the present disclosure, V forms VC (vanadium carbide) with C. Fine VC may hinder dislocations to certain extent. Meanwhile, as the dissolution temperature of VC is high, it can effectively prevent the movement of grain boundaries, refine grains and improve the strength of the steel. Under the condition of high quenching temperature, if the mass percentages of C and V are both high, coarse VC particles may be generated and deteriorate the impact performance of the steel. Therefore, taking into the amount of other alloying elements added in the present disclosure, the mass percentage of V in the technical solution of the present disclosure is controlled at 0~0.12% to ensure the mechanical properties of the steel.

Titanium (Ti): with respect to the low temperature ductile steel with ultra-high strength according to the present disclosure, Ti can form compounds with C or N in steel. The temperature for forming TiN is 1400° C. or more. TiN would typically precipitate from liquid phase or δ ferrite to achieve the refinement of austenite grains. If the mass percentage of Ti is too high, coarse TiN precipitation would be formed, resulting in a decrease in the impact and fatigue properties. Further, during the tempering process, if the mass percentage of Ti is too high, the fluctuation range of the low temperature impact energy would increase. On this basis, the mass percentage of Ti in the low temperature ductile steel with ultra-high strength according to the present disclosure is controlled at 0.003~0.06%.

Aluminum (Al): with respect to the low temperature ductile steel with ultra-high strength according to the present disclosure, Al would form fine AlN precipitates during smelting of the steel, which inhibits the growth of austenite grains in the subsequent cooling process to achieve the refinement of austenite grains and improve the toughness of steel at low temperature. However, if the mass percentage of Al is too high, it would lead to the formation of large Al oxides and lead to unacceptable ultrasonic flaw detection results of the steel. In addition, hard, coarse Al oxides inclusions may deteriorate the fatigue property of steel. On this basis, the mass percentage of Al in the low temperature ductile steel with ultra-high strength according to the present disclosure is controlled at 0.01~0.08% to improve toughness of the steel.

To sum up, the chemical composition system adopted in the low temperature ductile steel with ultra-high strength according to the present disclosure fully utilizes the influence of various alloying elements on phase transformation and microstructure to ensure the strength, low temperature impact toughness and elongation rate of the steel, so as to obtain a high-strength steel with a tensile strength of 1150 MPa and balanced ultra-high toughness and strong pliability.

Further, a low temperature ductile steel with ultra-high strength according to the present disclosure further comprises Cu in an amount of 0 to 0.30% and/or Ca in an amount of 0 to 0.005%. In the technical solution above, Cu is added into the steel to form fine nano-scale ε-Cu precipitation during the tempering process, so as to improve the strength of the steel. Meanwhile, adding a certain amount of Cu may help improve the corrosion resistance of the steel. However, considering that the melting point of Cu is low, if the mass percentage of Cu is too high, Cu would concentrate at the grain boundary during the heating and austenitizing process, which would weaken the grain boundary and leads to cracking. On this basis, in some preferred embodiments of the low temperature ductile steel with ultra-high strength according to the present disclosure, the amount of Cu is controlled to $0 \leq Cu \leq 0.30\%$.

In addition, in some embodiments, Ca can be added into the steel in an amount of 0.005% by mass or less to form CaS, so as to improve the size and morphology of the inclusions, and improve the low temperature impact toughness of the steel.

Further, in a low temperature ductile steel with ultra-high strength according to the present disclosure, inevitable impurities satisfy at least one of the following: $P \leq 0.015\%$, $S \leq 0.003\%$, $H \leq 0.0002\%$, $N \leq 0.0150\%$, $O \leq 0.0030\%$.

Phosphorus (P): P in the steel may segregate at the grain boundary, reducing the binding energy of the grain boundary and deteriorates the low temperature impact property of the steel. The co-existence of P and Mn may aggravate the temper brittleness of the steel. P segregated at the grain boundary may cause intergranular fracture of the steel when subjected to an impact load, forming a large cleavage surface, which reduces the energy absorbed when the steel is subjected to an impact. Therefore, the mass percentage of P is controlled to $P \leq 0.015\%$ to ensure the low temperature impact toughness of the low temperature ductile steel with ultra-high strength.

Sulfur (S): the solubility of S in the δ ferrite and austenite is low. S would segregate during the solidification of molten steel and form many sulfide inclusions, which would harm the ultrasonic flaw detection performance and low temperature impact performance of steel. CaS formed by adding S into the free cutting steel would improve the cutting performance of the steel. In the low temperature ductile steel with ultra-high strength according to the present disclosure, the main consideration in the control of mass percentage of S is to prevent the damage of coarse sulfide to impact property. In order to ensure good low temperature impact property of the steel, the mass percentage of S in the low temperature ductile steel with ultra-high strength according to the present disclosure is controlled to: $S \leq 0.003\%$.

Hydrogen (H): H would accumulate at the defects and form hydrogen embrittlement under the hydrostatic pressure filed of edge dislocation in the steel. With respect to the low temperature ductile steel with ultra-high strength according to the present disclosure, since it has a tensile strength of 1100 MPa or more, it has a high density of dislocations and sub-grain boundaries. If the mass percentage of H is too high, many H atoms would accumulate at the defects after the quenching and tempering heat treatment of steel. Concentration of H atoms would lead to the formation of H molecules, and result in delayed fracture of steel. Considering that when the low temperature ductile steel with ultra-high strength according to the present disclosure is made into an offshore platform mooring chain, it is highly possible that the high strength mooring chain may encounter delayed fracture in working conditions due to the corrosion of seawater and penetration of H to the mooring chain, endangering the safety of the offshore platforms. Therefore, the mass percentage of H is controlled to $H \leq 0.0002\%$ in the technical solution of the present disclosure.

Nitrogen (N): N would form AlN or TiN in steel to refine the grains of austenite. However, the increase in the mass percentage of N would lead to an increase in its enrichment at the defects and form coarse nitrides precipitates, thus the low temperature impact energy of the steel would be affected. On this basis, the mass percentage of N is controlled to $N \leq 0.0150\%$ in the technical solution of the present disclosure.

Oxygen (O): O together with Al in steel would form $Al_2O_3$, TiO or the like. In the technical solution of the present disclosure, the mass percentage of O is controlled to $O \leq 0.0030\%$ to ensure the structure uniformity and low temperature impact energy of the steel.

Further, in the low temperature ductile steel with ultra-high strength according to the present disclosure, the microstructure of the steel is tempered martensite and tempered bainite.

Further, in the low temperature ductile steel with ultra-high strength according to the present disclosure, the steel has a yield strength of ≥950 MPa, tensile strength of ≥1150 MPa, Charpy impact energy below −20° C. Akv of ≥75 J, elongation rate of ≥15%, percentage reduction of area after fracture of ≥55%.

Correspondingly, another object of the present disclosure is to provide a low temperature ductile steel bar with ultra-high strength. The steel bar has a tensile strength up to 1150 MPa, good low temperature toughness and elongation rate, and is suitable for applications where high-strength and toughness materials are required, such as mooring chains for offshore platform, automobiles and mechanical structures.

In order to achieve the above object, the present disclosure provides a low temperature ductile steel bar with ultra-high strength made from the aforementioned low temperature ductile steel with ultra-high strength.

Further, the low temperature ductile steel bar according to the present disclosure has a diameter of ≤180 mm.

In addition, another object of the present disclosure is to provide a manufacturing method of a low temperature ductile steel bar with ultra-high strength. A low temperature ductile steel bar with ultra-high strength can be prepared by the method. The low temperature ductile steel bar with ultra-high strength has a tensile strength of 1150 MPa, good low temperature toughness and elongation rate, and is suitable for applications where high-strength and toughness materials are required, such as mooring chains for offshore platform, automobiles and mechanical structures.

In order to achieve the above object, the present disclosure provides a manufacturing method of the low temperature ductile steel bar with ultra-high strength mentioned above, comprising the steps of:

smelting and casting;

heating;

forging or rolling;

quenching, wherein the austenitizing temperature during the quenching step is 840-1050° C., then water quenching after austenitizing; and tempering, wherein the tempering temperature is 500-650° C., then air cooling or water cooling after the tempering.

According to the technical solution of the present disclosure, the reasons for controlling the austenitizing temperature at around 840-1050° C. in the quenching step are as follows: during the process, carbides forming elements such as Nb, V, Ti, Cr and carbonitrides of Mo would dissolve completely or partially, while the undissolved carbonitrides would pin at the grain boundary of the austenite to prevent the austenite grains being too coarse, thereby achieve the refinement of grains after quenching and improve the strength and toughness of the steel. In the subsequent cooling process, the alloying elements dissolved in the austenite would improve the hardenability of the steel, so that the martensite would become finer and lead to the ultra-high strength and good toughness of the resulting low temperature ductile steel bar with ultra-high strength.

It should be noted that the casting step can be performed by die casting or continuous casting.

The quenched low temperature ductile steel bar with ultra-high strength is subject to tempering heat treatment at 500-650° C. This is because during the quenching process, steel would form lower bainite and martensite structure having high defect density, resulting in high internal strain storage and uneven internal stress distribution. During high temperature tempering process, Nb, V together with C, N would form fine carbides. Meanwhile, Cr and Mo would also form fine carbides precipitates during the high temperature tempering process, thereby improving the strength to match the toughness of the steel. In addition, the microstructure of the steel becomes more uniform due to high density dislocation annihilation and small angle grain boundary movements, thereby improving the low elongation rate after low temperature quenching. Within the tempering temperature range defined in the present disclosure, good toughness and pliability of the steel can be ensured, the internal strain of steel can be effectively reduced, which facilitates the process and use of the steel bar such as the manufacture of high performance R6 offshore platform mooring chains.

Further, in the manufacturing method of the present disclosure, the heating temperature in the heating step is 1050-1250° C.

In the technical solution mentioned above, the heating temperature is set to 1050-1250° C. This is because during the heating process, carbonitrides of Nb, V and Ti, carbides of Cr and Mo would dissolve in austenite completely or partially. In the subsequent rolling or forging and quenching step, Nb, V, and Ti would form fine carbonitrides, which pin the grain boundary of the austenite and refine the rolled structure of the steel. In addition, Cr and Mo dissolved in the austenite can improve the hardenability of steel. Cr and Mo dissolved in the austenite can improve the hardenability of martensite during quenching.

Further, in the manufacturing method according to the present disclosure, the finishing rolling temperature or finishing forging temperature is 800° C. or higher, but not higher than 1200° C.

In the technical solution above, under the condition of finishing rolling temperature or finishing forging temperature of ≥800° C., the steel would undergo recrystallization and strain-induced precipitation, thereby forming a multiphase matrix structure of refined bainite and martensite in which fine carbonitrides are precipitated, thus further improves the performance of the steel. If the temperature is over 1200° C., it would cause serious oxide layer on the steel surface. The intrusion of oxide layer during forging step would affect the quality of the surface.

Comparing with the prior art, the low temperature ductile steel with ultra-high strength, the low temperature ductile steel bar with ultra-high strength and the manufacturing method thereof according to the present disclosure have the following advantages and beneficial effects:

The chemical composition system adopted by the low temperature ductile steel with ultra-high strength according to the present disclosure fully utilizes the influence of various alloying elements on phase transformation and microstructure to ensure the strength, low temperature impact toughness and elongation rate of the steel, so as to obtain a high-strength steel with a tensile strength of 1150 MPa and balanced ultra-high toughness and strong pliability.

Further, the low temperature ductile steel with ultra-high strength according to the present disclosure has a tensile strength of 1150 MPa. The application of tempering process after the quenching step for the rolled or forged low temperature ductile steel bar with ultra-high strength can help form a matrix structure of tempered martensite and tempered bainite on which fine carbides are precipitated, which eliminates the internal stress of the steel and provides good uniformity of the structure.

In addition, the reasonable design and broad process window of the composition and manufacturing process of the low temperature ductile steel with ultra-high strength would achieve mass commercial production of the bars or steel plates.

DETAILED DESCRIPTION

Figure 1:
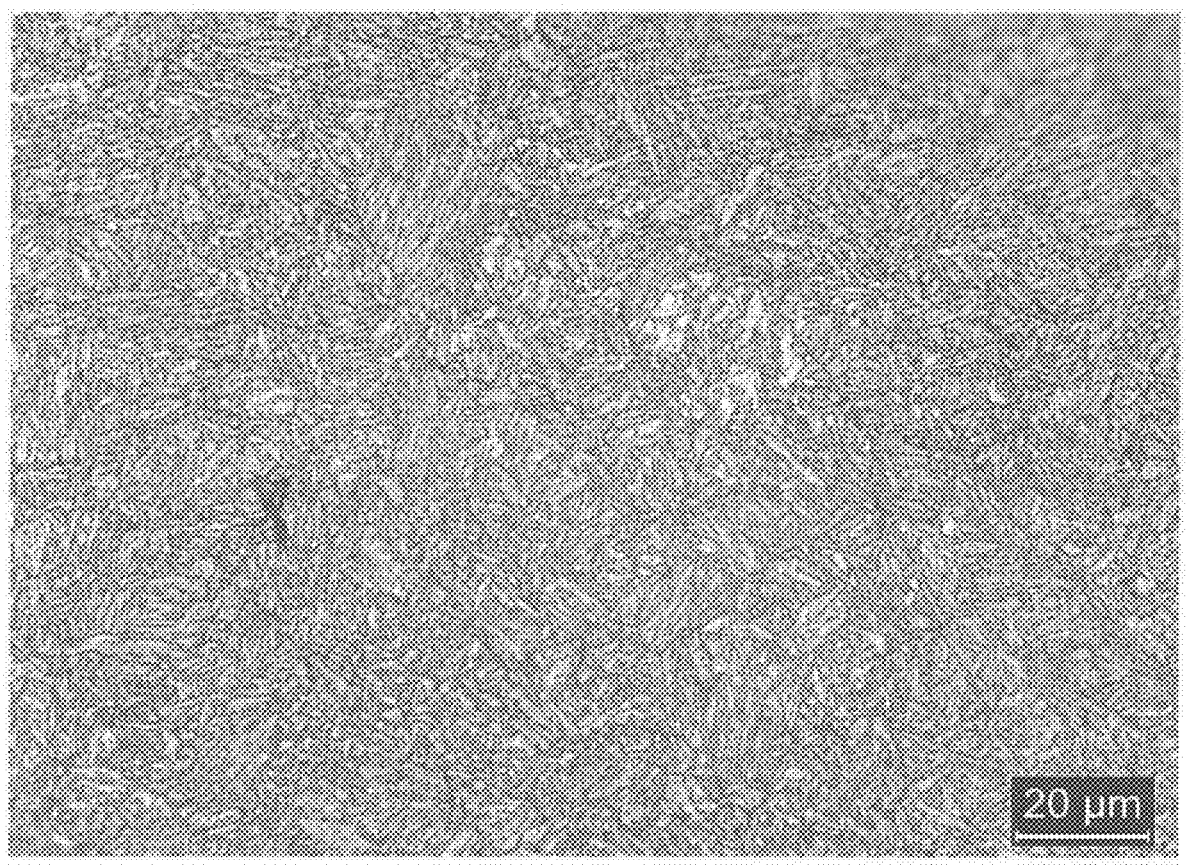
FIG. 1 shows the metallographic structure of the low temperature ductile steel bar with ultra-high strength according to Example 4 under optical microscope.

The embodiments of the present disclosure will be further described below in conjunction with the drawings and examples. However, the explanation and description are not intended to unduly limit the technical solutions of the present disclosure.

Examples 1-6

The low temperature ductile bars with ultra-high strength according to Examples 1-6 are produced by the following steps:

- Smelting and casting based on the chemical compositions listed in Table 1, wherein the smelting step can adopt converter steelmaking or circuit steelmaking, and casting to continuous casting slab;
- Heating the casing slab to 1050~1250° C. and holding the temperature for ≥1.5 h;
- Forging or rolling based on the parameters shown in Table 2;
- Quenching: the austenitizing temperature of the quenching step is 840-1050° C., then water quenching after austenitizing;
- Tempering: the tempering temperature is 500-650° C., then air cooling or water cooling after the tempering.

It should be noted that air cooling or slow cooling can be adopted after forging or rolling.

Table 1 lists the mass percentage of each chemical element in the low temperature ductile bars with ultra-high strength according to Examples 1-6.

TABLE 1

(wt %, and the balance of Fe and other inevitable impurities except P, S, H, N and O)

| Ex. | C | Si | Mn | P | S | Cr | Mo | Nb | Ni | Cu | V | Al | Ti | Ca | H | N | O | B |
|---|---|---|---|---|---|---|---|---|---|---|---|---|---|---|---|---|---|---|
| 1 | 0.15 | 0.50 | 0.50 | 0.015 | 0.002 | 1.18 | 0.80 | 0.06 | 2.00 | 0.28 | 0.12 | 0.05 | 0.05 | 0.005 | 0.00015 | 0.0120 | 0.0030 | 0.0008 |
| 2 | 0.170 | 0.40 | 0.70 | 0.011 | 0.002 | 1.06 | 0.70 | 0.08 | 2.30 | 0.24 | 0.09 | 0.04 | 0.06 | 0.001 | 0.00020 | 0.0080 | 0.0013 | 0.0013 |
| 3 | 0.200 | 0.30 | 0.80 | 0.009 | 0.001 | 0.92 | 0.50 | 0.05 | 2.70 | 0.17 | 0.07 | 0.07 | 0.02 | 0.002 | 0.00012 | 0.0030 | 0.0020 | 0.0019 |
| 4 | 0.210 | 0.20 | 1.10 | 0.007 | 0.003 | 0.70 | 0.40 | 0.03 | 3.00 | 0.10 | 0.05 | 0.08 | 0.015 | 0.003 | 0.00010 | 0.0050 | 0.0025 | 0.0029 |
| 5 | 0.220 | 0.20 | 1.30 | 0.010 | 0.002 | 0.50 | 0.30 | 0.02 | 3.40 | 0.06 | 0.04 | 0.02 | 0.003 | 0.003 | 0.00012 | 0.0060 | 0.0015 | 0.0038 |
| 6 | 0.240 | 0.10 | 1.50 | 0.008 | 0.001 | 0.30 | 0.20 | 0 | 3.70 | 0 | 0.02 | 0.01 | 0.010 | 0 | 0.00007 | 0.0040 | 0.0012 | 0.0045 |

Table 2 lists the specific process parameters of the low temperature ductile bars with ultra-high strength according to Examples 1-6.

Those skilled in the art may determine the holding duration, heating duration and tempering duration according to features such as diameter of the steel bar or the like to ensure that the steel bar is evenly heated, so that the core portion would reach the same temperature as the surface of the steel bar.

TABLE 2

| | Bloom heating step | | | Round steel forging or rolling step | | Quenching | | Tempering | |
|---|---|---|---|---|---|---|---|---|---|
| No. | Heating temp. (° C.) | Holding duration (min) | Finishing rolling temp. for inter. slab (° C.) | Heating temp. (° C.) | Finishing forging or rolling temp. (° C.) | Austenitizing quenching (° C.) | Heating duration (min) | Tempering temp. (° C.) | Tempering duration (min) |
| Ex. 1 | 1050 | 240 | 800 | 1070 | 800 | 840 | 30 | 500 | 60 |
| Ex. 2 | 1080 | 270 | 880 | 1100 | 830 | 870 | 100 | 530 | 60 |
| Ex. 3 | 1080 | 300 | 880 | 1120 | 940 | 900 | 150 | 560 | 100 |
| Ex. 4 | 1200 | 360 | 950 | 1150 | 980 | 930 | 150 | 590 | 180 |
| Ex. 5 | 1200 | 420 | 950 | 1200 | 1020 | 980 | 170 | 610 | 260 |
| Ex. 6 | 1200 | 480 | 950 | 1250 | 1020 | 1040 | 300 | 650 | 300 |

The low temperature ductile bars with ultra-high strength of Examples 1-6 were then subjected to performance test. The test results of round steel having different diameters are listed in Table 3 below.

TABLE 3

| Example | Steel bar diameter (mm) | Yield strength (MPa) | Tensile strength (MPa) | Elongation rate (%) | Percentage reduction of area after fracture (%) | Longitudinal impact energy at −20° C. (J) |
|---|---|---|---|---|---|---|
| 1 | 20 | 1000 | 1170 | 17.0 | 65 | 129/135/139 |
| 2 | 50 | 1020 | 1180 | 17.0 | 63 | 126/132/127 |
| 3 | 70 | 1060 | 1200 | 16.5 | 62 | 113/120/124 |
| 4 | 100 | 1110 | 1220 | 16.0 | 61 | 111/107/119 |
| 5 | 130 | 1130 | 1230 | 16.0 | 62 | 105/109/107 |
| 6 | 180 | 1140 | 1250 | 15.5 | 60 | 97/101/95 |

Note:
The three columns of the longitudinal impact energy at −20° C. represent the test results of three parallel samples, respectively.

According to Table 3, the Examples according to the present disclosure has a yield strength of ≥950 MPa, a tensile strength of ≥1150 MPa, a Charpy impact energy below −20° C. Akv of ≥75 J, an elongation rate of ≥15%, a percentage reduction of area after fracture of ≥55%. Thus, it can be concluded that the low temperature ductile bars with ultra-high strength have good strength, toughness at low temperature and pliability.

Figure 2:
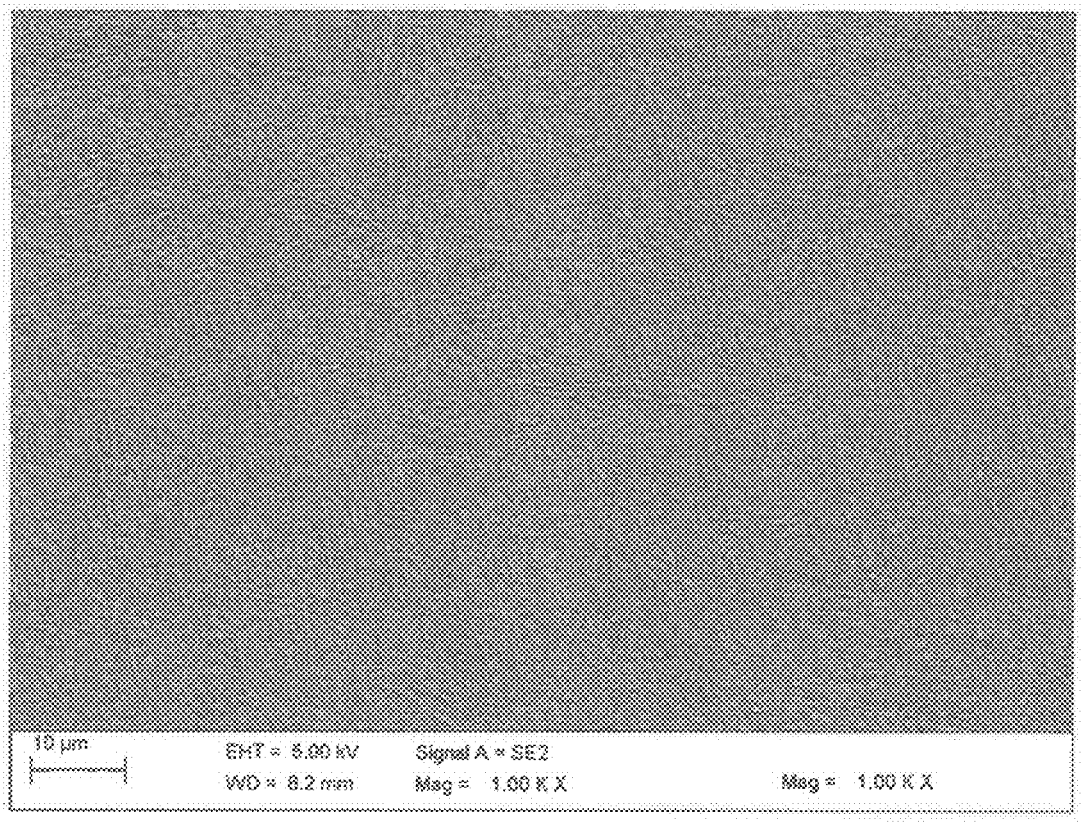
FIG. 2 shows the metallographic structure of the low temperature ductile steel bar with ultra-high strength according to Example 4 under scanning electron microscope.

FIG. 1 shows the metallographic structure of the low temperature ductile steel bar with ultra-high strength according to Example 4 under optical microscope. FIG. 2 shows the metallographic structure of the low temperature ductile steel bar with ultra-high strength according to Example 4 under scanning electron microscope.

Combining FIG. 1 and FIG. 2, it can be seen that the microstructure of the low temperature ductile steel bar with ultra-high strength according to Example 4 is tempered martensite and tempered bainite.

To sum up, the chemical composition system adopted in the low temperature ductile steel with ultra-high strength according to the present disclosure fully utilizes the influence of various alloying elements on phase transformation and microstructure to ensure the strength, low temperature impact toughness and elongation rate of the steel, so as to obtain a high-strength steel with a tensile strength of 1150 MPa and balanced ultra-high toughness and strong pliability.

Further, the low temperature ductile steel with ultra-high strength according to the present disclosure has a tensile strength of 1150 MPa. The application of tempering process after the quenching step for the rolled or forged low temperature ductile steel bar with ultra-high strength can help form a matrix structure of tempered martensite and tempered bainite on which fine carbides are precipitated, which eliminates the internal stress of the steel and provide good uniformity of the structure.

In addition, the reasonable design and broad process window of the composition and manufacturing process of the low temperature ductile steel with ultra-high strength would achieve mass commercial production of the bars or steel plates.

It should be noted that the portion of prior art in the protection scope of the present disclosure is not limited to the embodiments given herein. All prior art that does not contradict the solutions of the present disclosure, including but not limited to the previous patent documents, prior publications, prior applications, etc., can all be included in the protection scope of the present disclosure.

In addition, the combination of the technical features in the present disclosure is not limited to the combination described in the claims or the combination described in the specific examples. All technical features described herein can be freely combined in any way, unless contradicts between each other.

It should also be noted that the above-listed embodiments are only specific examples of the present disclosure. Obviously, the present disclosure should not be unduly limited to such specific embodiments. Changes or modifications that can be directly or easily derived from the present disclosure by those skilled in the art are intended to be within the protection scope of the present disclosure.

The invention claimed is:

1. A steel comprising the following chemical composition in percentage by mass: C: 0.15% to 0.24%, Sr, 0.10% to 0.50%, Mn: 0.60% to 1.50%, Cr, 0.30% to 1.20% Mo: 0.20% to 0.80%, Ni: 2.00% to 4.00%, Nb: 0% to 0.10% B: 0.0010% to 0.0050%, V: 0% to 0.12%, Ti: 0.003% to 0.06%, Al: 0.01% to 0.08%, and the balance being Fe and inevitable impurities, wherein the microstructure of the steel is tempered martensite and tempered bainite; and wherein the steel has a yield strength of ≥950 MPa, a tensile strength of ≥1150 MPa, a Charpy impact energy below −20° C. Akv of ≥75 J, an elongation rate of ≥15%, and a percentage reduction of area after fracture of ≥55%.

2. The steel according to claim 1, further comprising 0<Cu≤0.30% and/or 0<Ca≤0.005%.

3. The steel according to claim 1, wherein the inevitable impurities satisfy at least one of the following: P≤0.015%, S≤0.003%, H≤0.0002%, N≤0.0150%, and O≤0.0030%.

4. A steel bar comprising the following chemical composition in percentage by mass: C: 0.15% to 0.24%, Si: 0.10% to 0.50%, Mn: 0.60% to 1.50% Cr: 0.30% to 1.20%, Mo: 0.20% to 0.80%, Ni: 2.00% to 4.00%, Nb: 0% to 0.10%, B: 0.0010% to 0.0050% V: 0% to 0.12%, Ti: 0.003% to 0.06%, Al: 0.01% to 0.08%, and the balance being Fe and inevitable impurities, wherein the microstructure of the steel bar is tempered martensite and tempered bainite; and wherein the steel bar has a yield strength of ≥950 MPa, a tensile strength of ≥1150 MPa, a Charpy impact energy below −20° C. Aky of ≥75 J, an elongation rate of ≥15%, and a percentage reduction of area after fracture of ≥55%.

5. The steel bar according to claim 4, wherein the steel bar has a diameter of 180 mm or less.

6. The steel bar of claim 4, wherein the steel further comprises 0<Cu≤0.30% and/or 0<Ca≤0.005%.

7. The steel bar of claim 4, wherein the inevitable impurities satisfy at least one of the following: P≤0.015%, S≤0.003%, H≤0.0002%, N≤0.0150%, and O≤0.0030%.

8. A manufacturing method of the steel bar according to claim 4, comprising the steps of:

smelting and casting;

heating;

forging or rolling;

quenching: wherein the austenitizing temperature during the quenching step is 840-1050° C., then water quenching after austenitizing; and tempering: wherein the tempering temperature is 500-650° C., then air cooling or water cooling after the tempering.

9. The manufacturing method according to claim 8, wherein the heating temperature during the heating step is 1050-1250° C.

10. The manufacturing method according to claim 8, wherein the finishing rolling temperature or finishing forging temperature is ≥800° C.

11. The method of claim 8, wherein the steel bar has a diameter of 180 mm or less.

* * * * *